US009303606B2

(12) United States Patent
Moreira Coletto et al.

(10) Patent No.: US 9,303,606 B2
(45) Date of Patent: Apr. 5, 2016

(54) FUEL RAIL MADE OF A PLASTIC MATERIAL WITH A HEATING SYSTEM

(75) Inventors: Tulio Italico Moreira Coletto, São Paulo (BR); Fernando Lepsch, Campinas (BR); Alvaro Augusto Vasconcelos, Campinas (BR)

(73) Assignee: Robert Bosch Limitada, Campinas SP (BR)

( * ) Notice: Subject to any disclaimer, the term of this patent is extended or adjusted under 35 U.S.C. 154(b) by 0 days.

(21) Appl. No.: 13/990,851

(22) PCT Filed: Nov. 30, 2011

(86) PCT No.: PCT/BR2011/000441
§ 371 (c)(1),
(2), (4) Date: Jan. 10, 2014

(87) PCT Pub. No.: WO2012/071637

PCT Pub. Date: Jun. 7, 2012

(65) Prior Publication Data

US 2014/0109881 A1 Apr. 24, 2014

(30) Foreign Application Priority Data

Dec. 2, 2010 (BR) ..... 1005341

(51) Int. Cl.

| | |
|---|---|
| ***F02M 53/06*** | (2006.01) |
| ***F02M 53/02*** | (2006.01) |
| ***F02M 55/02*** | (2006.01) |
| ***F02M 61/16*** | (2006.01) |
| ***F02M 69/46*** | (2006.01) |
| *F02D 41/00* | (2006.01) |
| *F02D 41/04* | (2006.01) |
| *F02D 41/06* | (2006.01) |

(52) U.S. Cl.
CPC ..... *F02M 53/06* (2013.01); *F02M 53/02* (2013.01); *F02M 55/025* (2013.01); (Continued)

(58) Field of Classification Search
CPC ..... F02M 69/465; F02M 55/025; F02M 5500/9015; F02M 2200/95; F02M 61/166; F02M 35/10216; F02M 55/04; F02M 63/0225
USPC ..... 123/554–558, 444–448; 138/30; 392/485
See application file for complete search history.

(56) References Cited

U.S. PATENT DOCUMENTS 5,022,371 A * 6/1991 Daly ..... 123/468
7,481,205 B2 * 1/2009 Keeler et al. ..... 123/549
(Continued)

FOREIGN PATENT DOCUMENTS

JP 2011064090 3/2011
WO 2005019636 3/2005
(Continued)

OTHER PUBLICATIONS

International Search Report for Application No. PCT/BR2011/000441 dated Mar. 14, 2012 (3 pages).

*Primary Examiner* — Lindsay Low
*Assistant Examiner* — Long T Tran
(74) *Attorney, Agent, or Firm* — Michael Best & Friedrich LLP

(57) ABSTRACT

The present invention refers to a fuel rail made of plastic material with a heating system (10,100). The said rail is applied, mainly, in the form of devices for aiding the cold start of engines which consume fuels whose specific vaporization heat is high, for example, alcohol. The fuel rail made of plastic material with a heating system presents reduced cost and weight and the same functional characteristics if compared to the fuel rails known by the state of the art, which are usually made of metal. Furthermore, the said fuel rail made of plastic material with a heating system presents internal compartments configured in such a manner that the sliders containing slide pins (51, 52, 53) of the injection mold can be easily removed, since there is no formation of negative faces.

14 Claims, 7 Drawing Sheets

(52) U.S. Cl.
CPC ..... *F02M 61/166* (2013.01); *F02M 69/465* (2013.01); *F02D 41/0025* (2013.01); *F02D 41/047* (2013.01); *F02D 41/064* (2013.01); *F02D 2200/0606* (2013.01); *F02M 2200/60* (2013.01); *F02M 2200/9015* (2013.01); *F02M 2200/95* (2013.01)

(56) References Cited

U.S. PATENT DOCUMENTS

| | | | | |
|---|---|---|---|---|
| 2002/0108660 | A1* | 8/2002 | Braun et al. | 138/30 |
| 2003/0019477 | A1* | 1/2003 | Bodenhausen et al. | 123/456 |
| 2003/0162697 | A1* | 8/2003 | Takeuchi et al. | 514/9 |
| 2005/0051138 | A1* | 3/2005 | Haley et al. | 123/468 |
| 2006/0162697 | A1* | 7/2006 | Stieler et al. | 123/456 |
| 2009/0133676 | A1* | 5/2009 | Lepsch et al. | 123/549 |
| 2009/0199822 | A1* | 8/2009 | Doherty | 123/456 |
| 2012/0204843 | A1* | 8/2012 | Costa et al. | 123/549 |
| 2012/0224839 | A1* | 9/2012 | Zorzetto et al. | 392/485 |

FOREIGN PATENT DOCUMENTS

| | | |
|---|---|---|
| WO | 2006130938 | 12/2006 |
| WO | 2007028663 | 3/2007 |
| WO | 2009009846 | 1/2009 |

* cited by examiner

FUEL RAIL MADE OF A PLASTIC MATERIAL WITH A HEATING SYSTEM

BACKGROUND OF THE INVENTION

The present invention refers to an assembly which is constituted by a fuel rail made of plastic material with a heating system. The said rail is employed in cold start auxiliary devices of internal combustion engines which consume fuels with an elevated specific vaporization heat, for example, alcohol.

In the last few years a great popularization of vehicles that use simultaneously more than one fuel has occurred, for example, gasoline and alcohol/ethanol. These vehicles, when they operate with alcohol as fuel, usually need an additional fuel tank dedicated to an initial injection of gasoline in order to start in cold climates. This is due to the fact that alcohol presents a high specific vaporization heat when compared to gasoline. Based on this physical-chemical limitation of alcohol and with the objective of eliminating the additional gasoline tank, vehicle manufacturers have developed cold starting devices for alcohol which aid the combustion process through the pre-heating of the fuel.

A cold start device is generally fixed in an upper region of the engine block and is, as a rule, constituted by a fuel rail which has injection valves, elements for heating the fuel, ducts for the passage of fuel and their respective couplings. The said ducts of the rail, already known by the state of the art, are made of steel, especially, stainless steel. This is due to the fact that alcohol is highly corrosive. The fact that the ducts are made of metal elevates the production costs for the assembly, as well as, contributing to an increase in the vehicles weight. A fuel rail with heating from the state of the art can be verified, for example, from the document WO 2006/130938.

Due to the problem of cost and weight cited above, it was necessary to develop alternative materials, especially, for the confection of ducts for said rail with a heating system. One of the alternatives is the use of a plastic material in place of metal, with the objective of significantly reducing costs and the total weight of the device associated with such change.

This change presents, however, some drawbacks for its implementation. The first is related to the use of heating elements which reach, as a rule, temperatures which could damage the plastic material. A second difficulty is linked to the confection of the rail with a single piece of plastic material with a mold that allows maintaining its complex geometry resulting from its functional characteristics known by the state of the art and that, at the same time, allows a rapid and economical plastic injection process.

In the state of the art there are no rails which aggregate, on one hand low cost and reduced weight of a rail made of plastic material and, on the other which manages to promote an adequate heating of the fuel. Such type of rail can be seen in document US 2009/199822 A1 which comprises different parts to be assembled together (which comprises security due to leakage of fuel) and also does not guarantee proper start-up of an engine when heating the fuel since due to its geometry will have to heat all the fuel inside the rail.

It is worth observing that the production process for plastic material elements must be done, preferably, in a single injection step. Otherwise, a later fitting of several components must be undertaken, which can result in a loss of the confiability of the rail. It must be observed that the smaller the number of components, the greater the safety, since the chances of a fuel leak is smaller.

The formation of a rail made of plastic material, preferably, in a single piece which attends to the complex geometry necessary to attain an ideal heating of the fuel is one of the objectives of the present invention. In the metal rails of the state of the art, what increases their total cost is the connection of its main external elements, constituted by a main tube and by two secondary ducts. This connection is made, generally, through a welding process, where entire metallic elements, of innumerous shapes, are united by a weld bead. It is interesting to observe that in the metal rail of the state of the art, in order to have a correct flow of fuel with adequate heating, it is necessary that the main tube is positioned in a substantially lower inferior part of the assembly. The shape of the heated rail of the state of the art can, therefore, interfere in the standard layout of an engine, eventually creating obstacles to its installation in the assembly line due to the difficulty of access for tools.

SUMMARY OF THE INVENTION

The present invention refers to a set which constitutes a fuel rail made of plastic material with a heating system. The said rail is applied, mainly, in devices for aiding the cold start of engines which consume fuels whose specific vaporization heat is high, for example, alcohol. The fuel rail made of plastic material with a heating system presents a reduced cost and the same functional characteristics if compared to the metal fuel rails with heating systems known by the state of the art. Further, the said fuel rail is made of plastic material with a heating system that presents an improved spatial arrangement of its elements, where its external shape and the internal compartments are configured in such a manner, that slide pins employed in the plastic injection process can easily be removed as a function of the absence of negative faces.

BRIEF DESCRIPTION OF THE DRAWINGS

The present invention will be described, as follows, in greater detail based on an embodiment represented in the drawings. The figures show.

DETAILED DESCRIPTION

Figure 1:
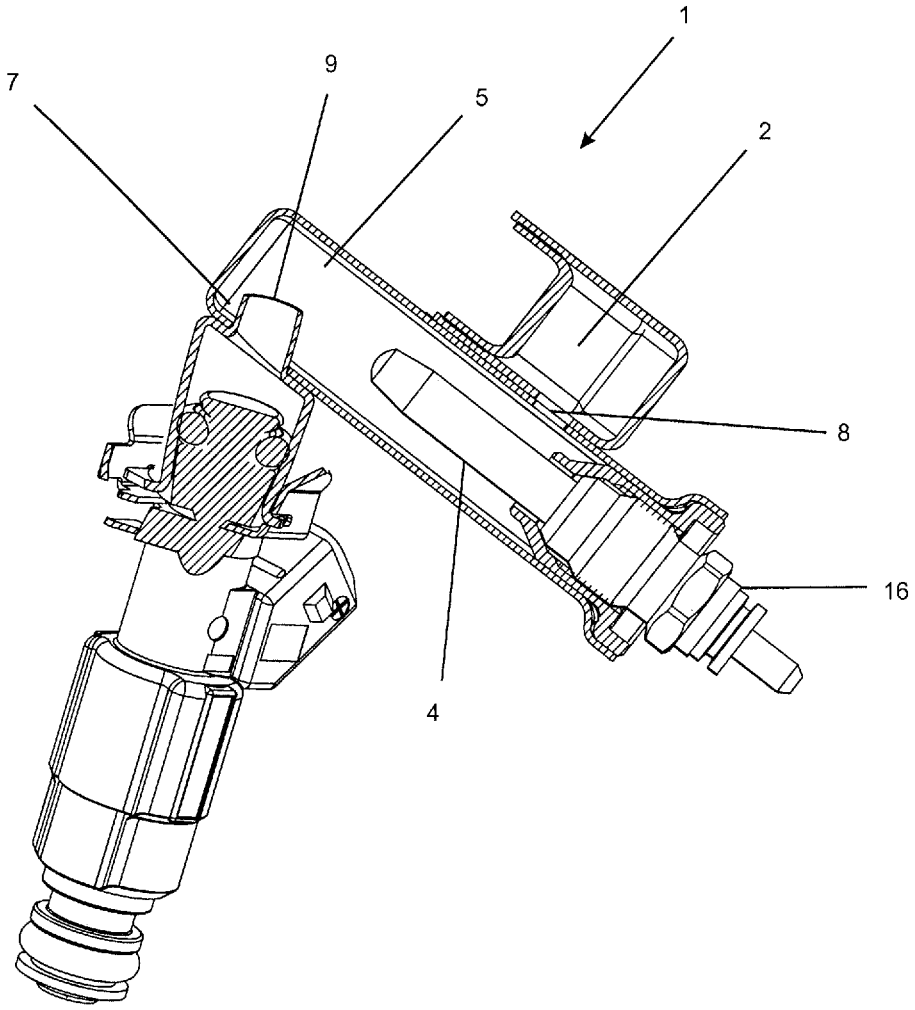
FIG. 1 Prior Art
FIG. 1—is a cross sectional view of a fuel rail made of metal known by the state of the art.
Figure 2:
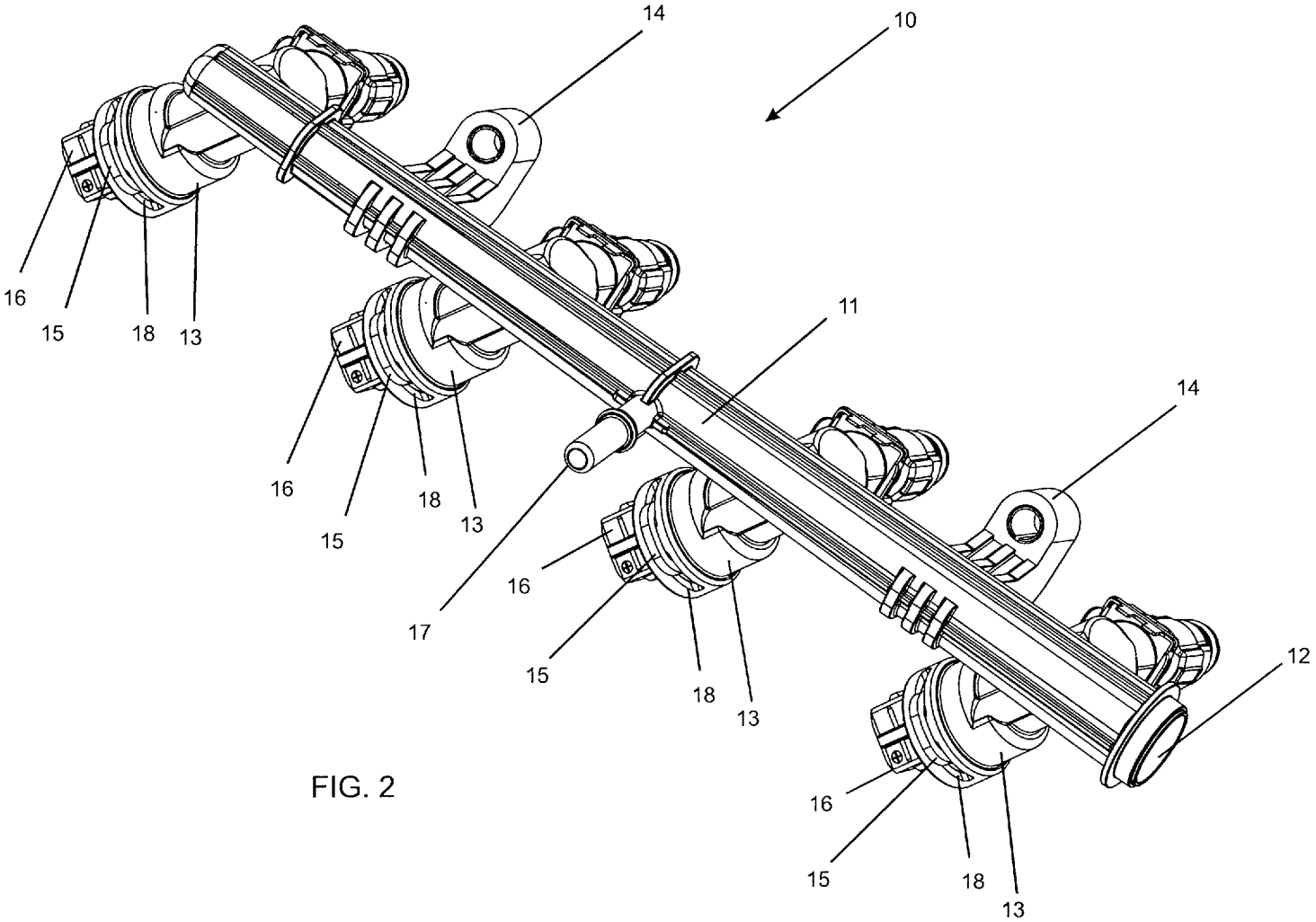
FIG. 2—is a perspective view of the fuel rail made of plastic material with a heating system of the present invention.
Figure 4:
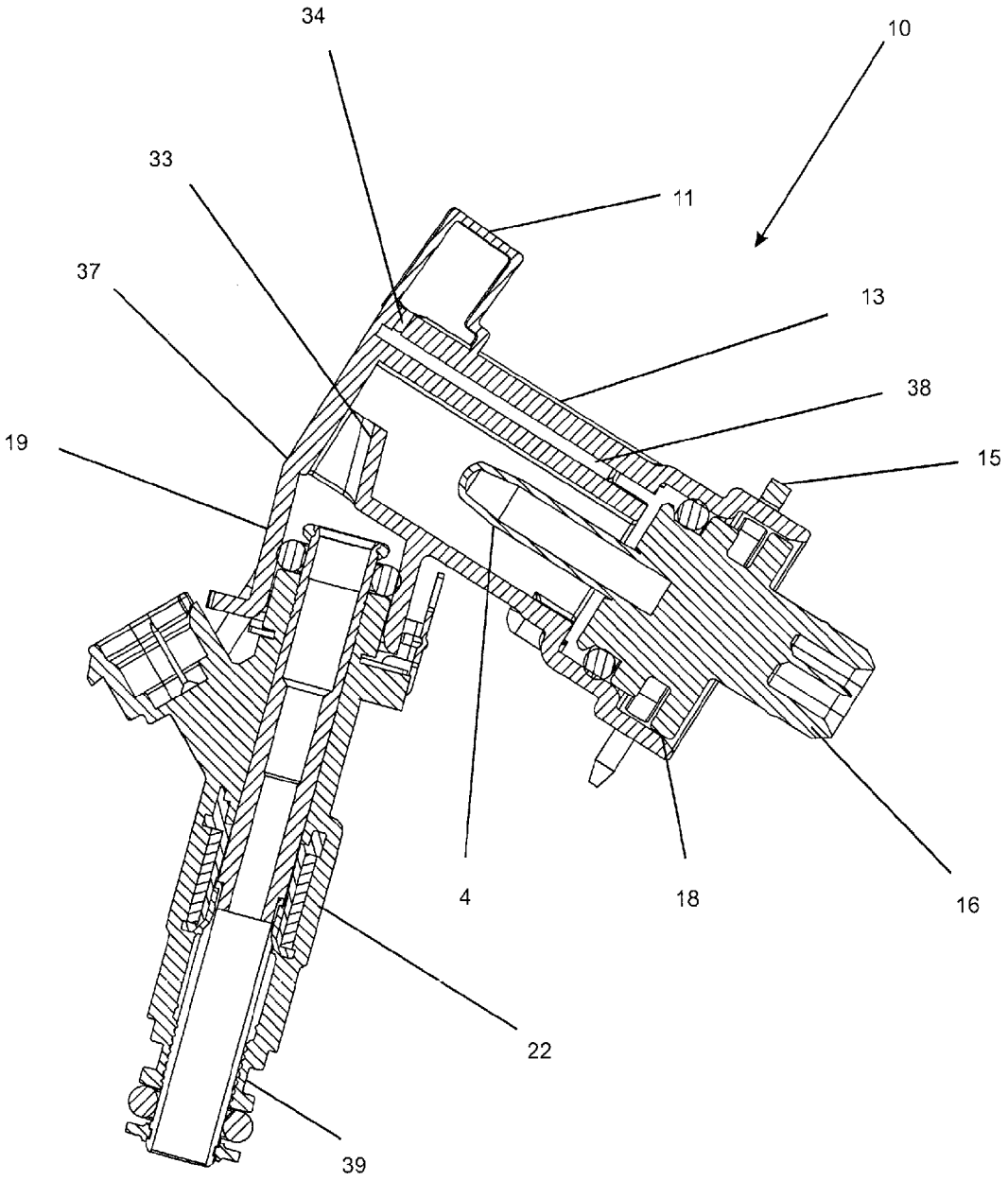
FIG. 4—is a cross sectional view of the fuel rail made of plastic material with a heating system of the present invention.

A metal fuel rail 1 known by the state of the art is shown in FIG. 1 in order to illustrate the main differences between the said rail and the fuel rail made of plastic material with a heating system 10 of the present invention shown in FIG. 2 and especially in FIG. 4. In the rail 1, it can be noticed that a main tube 2 presents itself arranged in a lower portion of an upper secondary duct 5. This geometric arrangement is necessary for the correct operation of the said rail 1, and results, however, in a reduction in the useful space of the engine hood. This is due to the fact that for the installation/maintenance of the engine components it is necessary to insert corresponding tools in said space. Thus, with the main tube 2 in the shown position, the handling of the tools is made more difficult. If the main tube 2 was in an upper position, closer to the upper extremity of the upper secondary duct 5, for example, to ease assembly, the heating process of the fuel would be compromised due to a necessary repositioning of orifice 8 which connects the main tube 2 with the upper secondary duct 5. The orifice 8 being very close to the entry of the fuel sending element 9 hinders the transfer of heat, since the fuel would not travel a sufficiently long course exposed to the heating of the lance 4. Another problem of the state of the art which can be observed in FIG. 1 is the fact that in the pre-heating phase, where the discharge of fuel is substantially low or even zero/none, the heated fuel can undertake a return trajectory to orifice 8, bearing in mind that its elevated temperature results in a lower density compared to unheated fuel, which would result in the heat exchange of fuel in the main tube. This occurs due to the fact that heat provided by the lance 4 is in a lower position if compared to the orifice 8. In other words, the orifice 8 in not located in the most lower portion of the secondary duct 5.

Another problem shown in FIG. 1 is in the shape and positioning of the fuel sending element 9. This configuration for the fuel sending element 9 used for rails made of metal leads to the occurrence of negative faces 7, in an injection mold, which makes impossible the production of a fuel rail made of plastic material with a heating system 10, as a result of the impossibility of the removal of the slider containing the slide pin.

On the other hand, the present invention can be seen in FIG. 2, where a main tube 11 of the fuel rail made of plastic material with a heating system 10 is shown. The tube 11 has the function of distributing the fuel along its length and supporting the fixation supports 14 and the secondary ducts which will be shown afterwards. It can be noticed that the tube 11 has a series of connections with upper secondary ducts 13 which comprehend heating elements 16. The said heating elements 16 are responsible for the function of heating the fuel in the rail 10. The elements 16, which can be better seen in FIGS. 3 and 4, have a lance 4 which includes an internal resistance which dissipates electrical energy in the form of heat. Further, there is a base which serves not only for sealing the upper secondary duct 13, but also to connect the source of electrical energy, this connection being done in a lower extremity of said element 16 external to the rail 10. It is possible to see also the fixing clamps 15 which have a shape compatible with their respective application in the slots 18 arranged spaced out along the entire radial region of the lower extremities of the secondary upper ducts 13. These clamps 15 have as their main function to permit the fixing of the heating elements 16 in the upper secondary ducts 13.

The fixation supports 14 of the rail 10 are arranged spaced out along the longitudinal length of the main tube 11. These supports 14 can be fixed through fixation elements, for example, screws (not shown in the figure) applied in openings in its base, in such a manner that the rail 10 finds itself fixed to an upper region of the vehicle's engine block. The number of fixation elements 14 can vary according to the total length of the rail 10, which depends on the spacing and the number of lower and upper secondary ducts 13 and 19 applied. This variation can also occur according to the de-termination of the tolerable vibration limits for the rail 10.

In FIG. 2, the closing element 12 of the main tube 11 can be seen. Through this closing element the rod of the rail's injection process is removed. The closing 12 is undertaken in a further step to the rail's injection.

Figure 3:
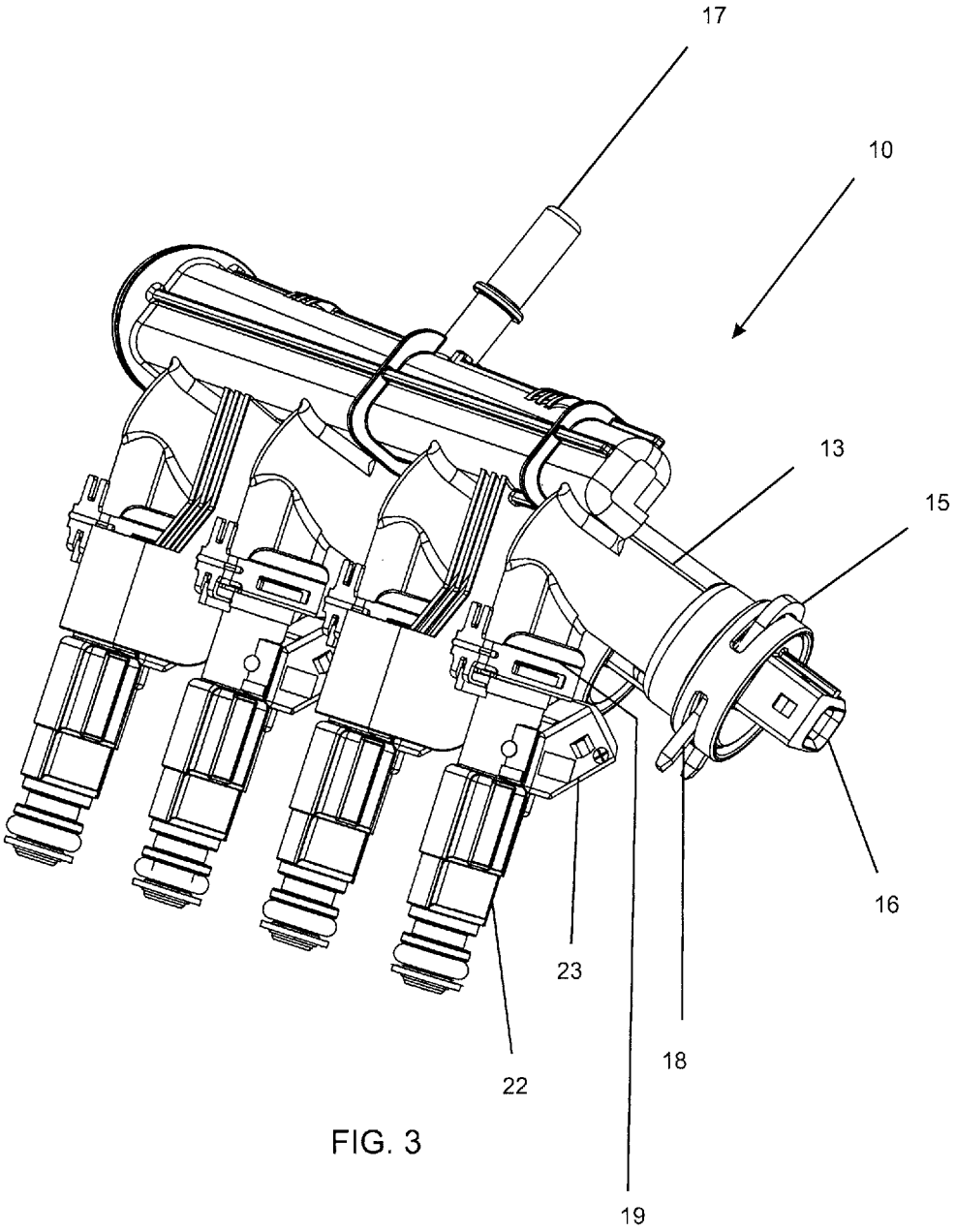
FIG. 3—is a left lateral view of the fuel rail made of plastic material with a heating system of the present invention.

The FIG. 3 presents a left side view of the fuel rail 10 made of plastic material with a heating system, in which some important elements which compose the said rail 10 can be better seen.

These elements are the upper secondary ducts 13 and the lower secondary ducts 19. The said lower ducts 19 comprehend fuel injection valves 22 which will receive the heated fuel and inject it, in a pulverized form, in a combustion chamber.

On the other hand the upper secondary ducts 13 have heating elements 16 which are responsible for the main function of the rail 10, which is to adequately heat the fuel and ease the engine start.

The fuel admission duct 17 is arranged in such a manner that it follows the angle of inclination of the main tube 11 and with that, eases the future fitting of the rail 10 to other engine components.

There is still a connector 23 which serves for the connection of electrical energy to the fuel injection valve 22.

FIG. 4 presents a cross sectional view of the fuel rail made of plastic material with a heating system 10, in which its internal compartments can be seen in greater detail. Further, the upper secondary duct 13, the lower secondary duct 19, an internal duct 38, the heating element 16 and the injection valve 22 can be seen, permitting the understanding of the rail 10 and the route taken by the fuel. This route begins in the fuel admission duct 17 (shown in FIG. 3), then, the distribution of the fuel under pressure occurs along the entire length of the main tube 11. This fuel flows through the orifice 34 to the internal duct 38 and is thus transported to the upper secondary duct 13. The outlet of the duct 38 conducts the fuel to the base of the heating element 16. At the end of this duct 38 a recess 72 (seen in FIG. 7) is provided which makes the flow of fuel to be directed to a lower region of the lance 4 opposed to the duct 38. Thanks to this additional direction of fuel, the fuel is heated in an optimized manner through contact with the lance 4 until it reaches a fuel sending element 33. By passing through the fuel sending element 33, the fuel flows to the injection valve 22 which injects the pulverized fuel in the combustion chamber.

Figure 5:
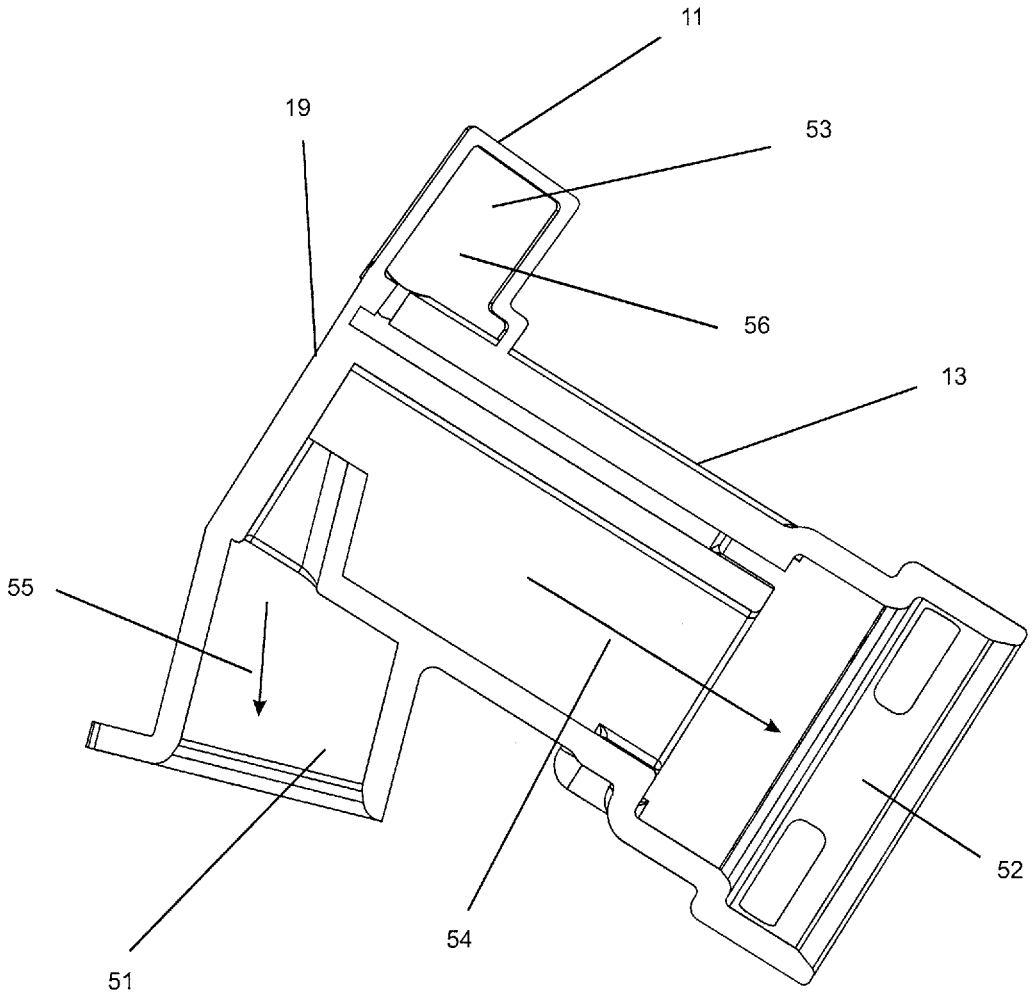
FIG. 5—is a schematic cross sectional view of the fuel rail made of plastic material with a heating system of the present invention, showing the direction for the removal of the slider containing the slide pins in the plastic injection process.

It is important to note that the fuel sending element 33, according to the present invention, does not present negative faces, as can be seen in on FIG. 5, bearing in mind that it is limited by the internal walls of the upper secondary duct 13. Another detail to be noted is that the angle that the fuel sending element 33 makes with the internal wall 37 of the rail 10 possesses as its maximum limit the central axis of the injection valve 22. This limit occurs due to the configuration of the slide pins, since these can be removed from where they entered during the injection process.

The internal duct 38 has as its main function the improvement of the conduction of the flow of fuel in relation to what is already known in the state of the art, for example, as shown in FIG. 1. The flow of fuel coming from the main tube 11, as a result of duct 38, directly focuses on the base of the lance 4, responsible for the transmission of heat to the fuel. This duct 38, which is arranged internally in the upper secondary duct 13, begins on an internal wall 37 of the upper secondary duct and extends until a point close to the base of the heating element 16. Another internal duct 38 can eventually be used for the conduction of the fluid to the base of the lance 4 of the heating element 16. The shape of the internal duct 38 can be circular of in the form of a circular segment.

The injection valve 22, which is in itself already known from the state of the art can assume varied shapes and is also shown in details in FIG. 4. The body of the valve 39 is arranged in a concentric manner to the lower secondary duct 19.

FIG. 5 shows in a schematic manner the direction of the movement of the main injection sleeves containing slide pins of the injection mold responsible for the formation of the fuel rail made of plastic material with a heating system 10 during the piece's extraction process. It is worth remembering that for economic and leakage reasons the injection of the rail 10 must occur in a single step, being, therefore, the respective injection mold correspondingly complex.

The slider with the slide pin 51 of the mold is responsible for the formation of the lower secondary duct 19 and its removal from the injected piece occurs in a direction indicated by the arrow 55 in FIG. 5. This arrow 55 has an opposite direction in the closing of the mold with the insertion of the respective slider with the slide pin 51 when the mold is prepared for injection. It is important to note that the fuel sending element 33 is geometrically configured in a manner that permits the removal of the slider with the slide pin 51. This becomes possible through the concentricness which exists between the axes of the fuel sending element 33 and the lower secondary duct 19 in the rail of the present invention.

The slider with the slide pin 53 is responsible for the formation of the main tube 11 and is removed in a direction 56. The slider containing the slide pin 52 of the mold is responsible for the formation of the upper secondary duct 13 and is removed in the direction 54 during the process for the opening of the mold and the corresponding extraction of the injected piece.

The rail of the present invention can be made of a single material, for example, a thermoplastic of the polyamide family, (for example, PA66), with or without the use of a reinforcement material, such as fiberglass, in quantities of 15 to 40%. It can also be done with a blend of thermoplastic materials or in co-injection with the employment of several thermoplastics (for example, PA, POM, PEEK, etc.), whenever this becomes necessary for reasons of mechanical or thermal resistance.

Figure 6:
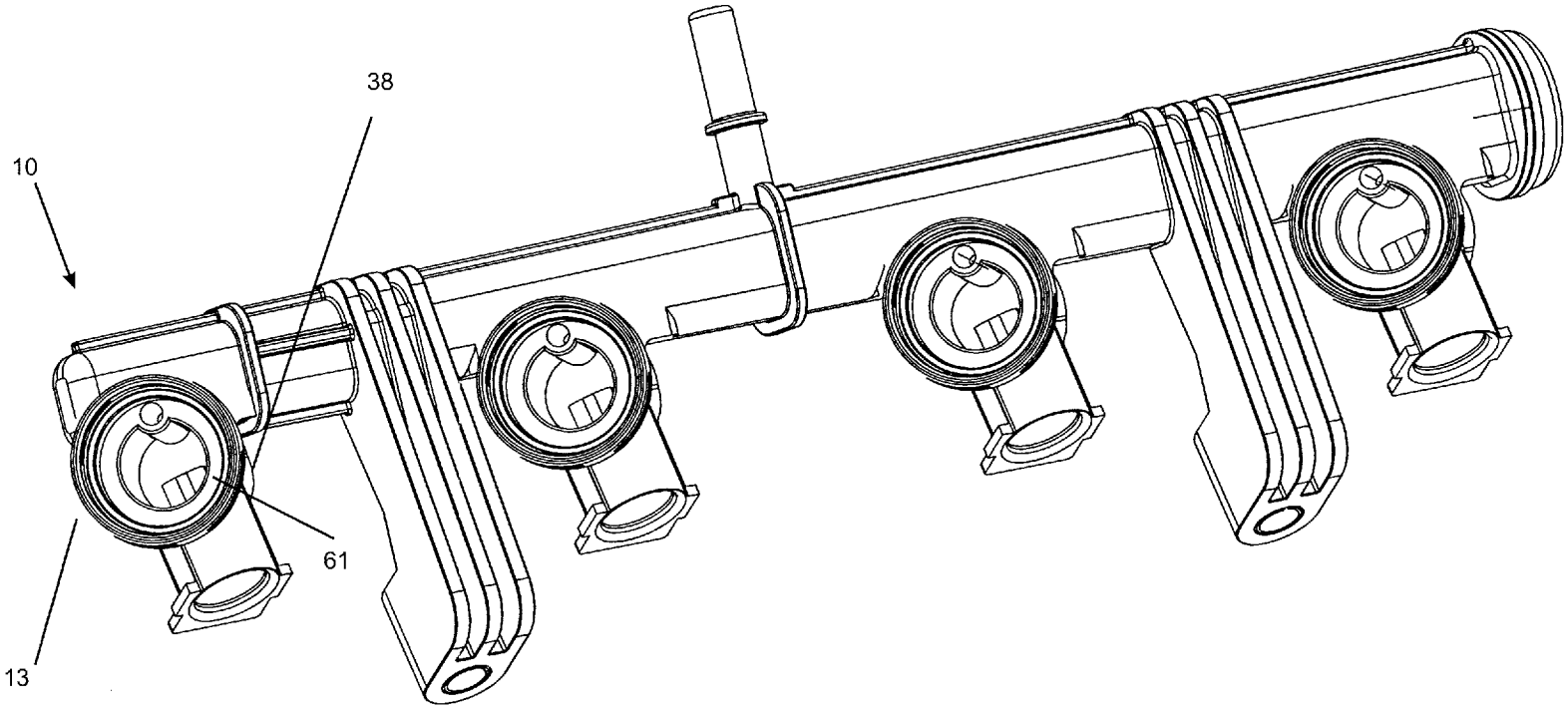
FIG. 6—is a view of the fuel rail made of plastic material with a heating system with an emphasis on the upper secondary duct.

FIG. 6 presents a view of the fuel rail made of plastic material with a heating system 10 that shows the upper secondary duct 13 in detail. In a first embodiment of the present invention, the surface 61, where the exit of the internal duct 38 or internal ducts 38 occurs, is flat, that is, the flow of fuel as it reaches the end of the internal duct 38 will distribute itself in a uniform manner throughout the base of the heating element 16.

Figure 7:
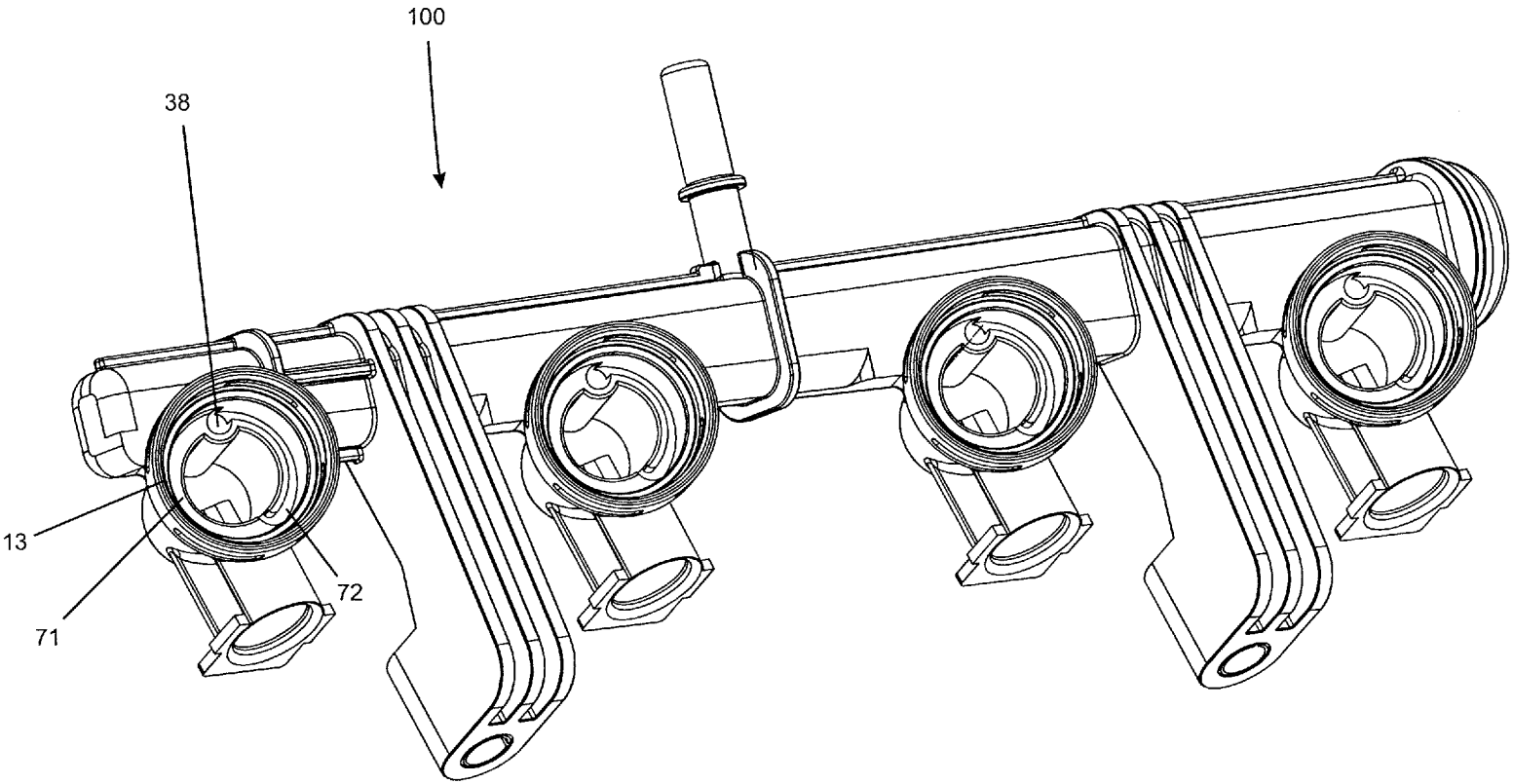
FIG. 7—is a view of an optional embodiment of the fuel rail made of plastic material with a heating system with an emphasis on the upper secondary duct.

FIG. 7 presents a view of a fuel rail made of plastic material with a heating system 100 which shows the upper secondary duct 13 in detail. In a second embodiment of the present invention, the surface 71, where the exit of the internal duct 38 occurs, presents a recess 72, which permits that the flow of fuel in reaching the end of the internal duct 38 be directed, through the said recess 72, to a lower portion of the base of the heating element 16. This makes the process of heating the fuel optimized, bearing in mind that it involves the lance 4 of the heating element 16, travel-ling along a longer route and in this manner increasing the contact time between the fuel and the said lance 4, which is responsible of the transmission of heat. The recess 72 can also exist on both sides of the surface 71, that is, on the left and right sides in order to optimize even further the trajectory of the flow of fuel.

Having described a preferred exemplary embodiment, it must be understood that the scope of the present invention includes other possible variations, not only being limited by the content of the appended claims, there included all the possible equivalents.

The invention claimed is:

1. A single piece fuel rail made of plastic material with a heating system (10; 100) for internal combustion engines with a cold start system, the fuel rail comprising:

a main tube (11);

at least one orifice (34) which connects the main tube (11) to at least one upper secondary duct (13);

the at least one upper secondary duct (13) including a heating element (16);

the heating element (16) including a lance (4) for the transmission of heat to fuel and a base for sealing the at least one upper secondary duct (13);

at least one lower secondary duct (19) which possesses a fuel sending element (33) extending into an internal part of the upper secondary duct (13) and which at least partly defines a passageway between the upper secondary duct (13) and the lower secondary duct (19) through which fuel flows into the lower secondary duct (19) for injection by a fuel injection valve (22) distinct from the lower secondary duct (19), wherein the main tube (11) is located in a region next to an upper extremity of the upper secondary duct (13), the upper secondary duct (13) contains at least one internal duct (38) in communication with the at least one orifice (34), wherein the at least one internal duct (38) conducts fuel from the main tube (11) to a lower extremity of the upper secondary duct (13) adjacent the base of the heating element (16), and wherein the fuel then travels in the upper secondary duct (13) along the lance (4) and into the lower secondary duct (19) through the passageway defined by the fuel sending element (33).

2. The rail, according to claim 1, further including a surface (71) located in an exit region of the at least one internal duct (38), of which this surface (71) includes at least one recess (72).

3. The rail, according to claim 1, further including fixation supports (14) arranged along a longitudinal length of the main tube (11).

4. The rail, according to claim 1, further including an admission duct (17) located on an upper face of the main tube (11).

5. The rail, according to claim 1, wherein at least one upper secondary duct (13) possesses at least one clasp (15) for fixation of the heating element (16).

6. The rail, according to claim 1, further including a closing element (12), arranged on an extremity of the main tube (11).

7. The rail, according to claim 1, wherein the rail is manufactured by a plastic injection process.

8. The rail, according to claim 7, wherein the plastic is a polyamide of the type PA66.

9. The rail, according to claim 7, wherein a mold employed in the injection process is free of negative surfaces.

10. The rail, according to claim 1, wherein the rail is produced in a thermoplastic or blend of thermoplastics.

11. The rail, according to claim 10, wherein the thermoplastic or blend of thermoplastics includes charges and reinforcement materials.

12. The rail, according to claim 10, wherein the thermoplastic or blend of thermoplastics is free of charges and reinforcement materials.

13. The rail, according to claim 1, wherein the fuel sending element (33) does not present negative faces, thereby permitting the rail to be made of plastic as a single piece.

14. The rail, according to claim 1, wherein a surface (71) containing an exit of the internal duct (38) includes a recess (72) that directs fuel exiting the internal duct through the recess and to the lower extremity of the upper secondary duct (13) adjacent the base of the heating element (16).

* * * * *